US011466571B1

(12) United States Patent
Joly et al.

(10) Patent No.: US 11,466,571 B1
(45) Date of Patent: Oct. 11, 2022

(54) DAMPING DEVICE

(71) Applicant: Safran Aircraft Engines, Paris (FR)

(72) Inventors: Philippe Gerard Edmond Joly, Moissy-Cramayel (FR); Marie-Oceane Parent, Moissy-Cramayel (FR); Francois Jean Comin, Moissy-Cramayel (FR); Romain Nicolas Lagarde, Moissy-Cramayel (FR); Jean-Marc Claude Perrollaz, Moissy-Cramayel (FR); Laurent Jablonski, Moissy-Cramayel (FR); Charles Jean-Pierre Douguet, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 887 days.

(21) Appl. No.: 16/221,910

(22) Filed: Dec. 17, 2018

(30) Foreign Application Priority Data

Dec. 20, 2017 (FR) ..... 17 62586

(51) Int. Cl.
*F01D 5/10* (2006.01)
*F01D 5/22* (2006.01)
*F01D 5/26* (2006.01)

(52) U.S. Cl.
CPC ..... *F01D 5/10* (2013.01); *F01D 5/22* (2013.01); *F01D 5/26* (2013.01); *F05D 2220/36* (2013.01); *F05D 2260/96* (2013.01)

(58) Field of Classification Search
CPC ..... F01D 11/006; F01D 25/04; F01D 25/06; F01D 5/26; F01D 5/10
See application file for complete search history.

(56) References Cited

U.S. PATENT DOCUMENTS 4,723,889 A * 2/1988 Charreron ..... F01D 21/045 416/193 A
8,646,978 B2 * 2/2014 Jadczak ..... F16C 33/586 384/537

(Continued)

FOREIGN PATENT DOCUMENTS

CN 204941612 U * 1/2016
EP 2 058 526 A1 5/2009

(Continued)

OTHER PUBLICATIONS

CN 204941612 English Specification, Espacenet Translate (Year: 2016).*

(Continued)

*Primary Examiner* — Ninh H. Nguyen
*Assistant Examiner* — John S Hunter, Jr.
(74) *Attorney, Agent, or Firm* — Oblon, McClelland, Maier & Neustadt, L.L.P.

(57) ABSTRACT

A turbomachine assembly is provided. The assembly includes: a first rotor module including a first blade, a second rotor module, connected to the first rotor module, and including a second blade of smaller length than the first blade, and a damping device including a plurality of first radial external surfaces supported with friction against the first module. The damping device is stepped, and includes a second radial external surface supported with friction against the second module, so as to couple the modules for the purpose of damping their respective vibrational movements during operation.

11 Claims, 8 Drawing Sheets

(56) References Cited

U.S. PATENT DOCUMENTS

Figure 1:
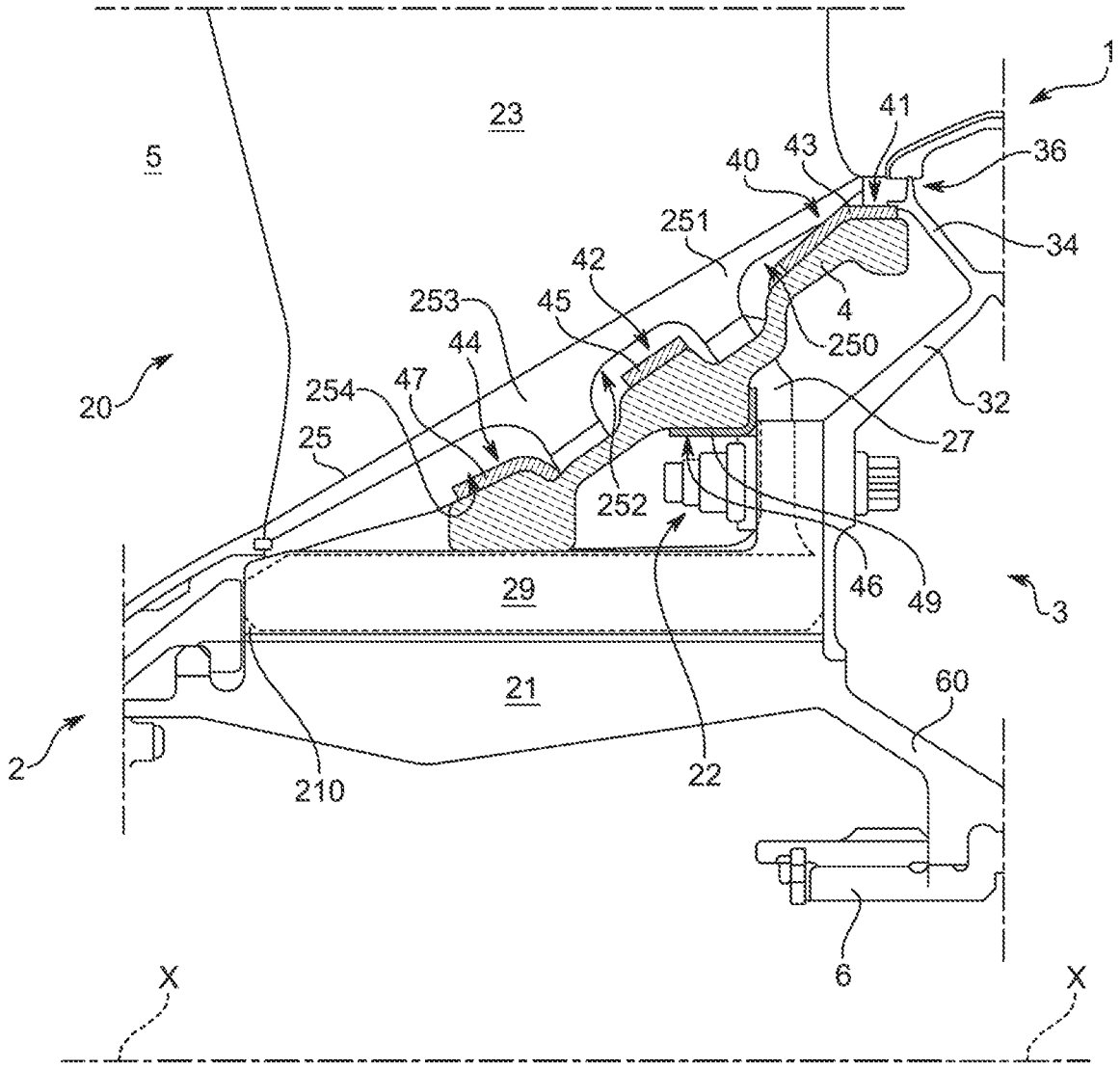

| | | | | |
|---|---|---|---|---|
| 8,911,210 | B2 * | 12/2014 | Bilz | F01D 5/3053 416/193 A |
| 2009/0123286 | A1 | 5/2009 | Mace et al. | |
| 2017/0211592 | A1 | 7/2017 | Klauke | |

FOREIGN PATENT DOCUMENTS

| | | | |
|---|---|---|---|
| EP | 3 199 758 | A1 | 8/2017 |
| FR | 3 027 341 | A1 | 4/2016 |

OTHER PUBLICATIONS

French Preliminary Search Report dated Aug. 9, 2018 in Patent Application No. FR 1762586 (with English translation of categories of cited documents), 3 pages.

* cited by examiner

DAMPING DEVICE

TECHNICAL FIELD

The invention relates to an assembly comprising a turbomachine rotor module.

The invention relates more specifically to an assembly for a turbomachine comprising two rotor modules and a damping device.

PRIOR ART

A turbomachine rotor module generally comprises one or more stage(s), each stage comprising a disk centered on a turbomachine longitudinal axis, corresponding to the axis of rotation of the rotor module. The rotation of the disk is generally ensured by a rotating shaft to which it is integrally connected, for example by means of a rotor module trunnion, the rotating shaft extending along the turbomachine longitudinal axis. Blades are mounted on the external periphery of the disk, and distributed circumferentially in a regular manner around the longitudinal axis. Each blade extends from the disk, and also comprises an airfoil, a platform, a support and a root. The root is embedded in a recess of the disk configured for this purpose, the airfoil is swept by a flow passing through the turbomachine and the platform forms a portion of the internal surface of the flow path.

The range of operation of a rotor module is limited, in particular due to aeroelastic phenomena. The rotor modules of modern turbomachines, which have a high aerodynamic loading and a reduced number of blades, are more sensitive to this type of phenomena. In particular, they have reduced margins between the operating zones without instability and the unstable zones. It is nevertheless imperative to guarantee a sufficient margin between the stability range and that of instability, or to demonstrate that the rotor module can operate in the unstable zone without exceeding its endurance limit. This allows guaranteeing risk-free operation over its entire life and the entire range of operation of the turbomachine.

Operation in the zone of instability is characterized by coupling between the fluid and the structure, the fluid applying the energy to the structure, and the structure responding with its natural modes at levels which can exceed the endurance limit of the material constituting the blade. This generates vibrational instabilities which accelerate the wear of the rotor module and reduce its lifetime.

In order to limit these phenomena, it is known to implement a system damping the dynamic response of the blade, so as to guarantee that it does not exceed the endurance limit of the material, regardless of the operating point of the rotor module. However, most of the known systems of the prior art are dedicated to dampen vibration modes with non-zero dephasing, and characterizing an asynchronous response of the blades to aerodynamic forces. Such systems have for example been described in documents FR 2 949 142, EP 1 985 810 and FR 2 923 557, in the Applicant's name. These systems are all configured to be accommodated between the platform and the root of each blade, in the recess delimited by the respective supports of two successive blades. Moreover, such systems operate, when two successive blade platforms are moved with respect to one another, by dissipating the vibration energy, by friction for example.

However, these systems are completely ineffective for damping vibration modes having a zero-dephasing involving the blades and the rotor line, i.e. its rotating shaft. Such modes are characterized by a flexure of the rotor blades with zero inter-blade dephasing implying a non-zero moment on the rotating shaft. In addition, this is a coupled mode between the blade, the disk and the rotating shaft. More precisely, the torsion within the rotor module, resulting for example from reverse forces between a turbine rotor and a compressor rotor, lead to flexural movements of the blades with respect to their attachment to the disk. These movements are greater the longer the blade, and the more the attachment is flexible.

Thus, there exists a need for a damping system for a turbomachine rotor making it possible to limit the instabilities generated by all modes of vibration as previously described.

SUMMARY OF THE INVENTION

One goal of the invention is to dampen vibration modes with zero dephasing for all types of turbomachine rotor modules.

Another goal of the invention is to influence the damping of vibration modes with non-zero dephasing, for all types of turbomachine rotor modules.

Another goal of the invention is to propose a damping solution that is simple and easy to implement.

The invention proposes in particular a turbomachine assembly comprising:

- a first rotor module comprising a first blade,
- a second rotor module, connected to the first rotor module, and comprising a second blade of smaller length than the first blade, and
- a damping device comprising a plurality of first radial external surfaces supported with friction against the first module, characterized in that the damping device is stepped, and comprises a second radial external surface supported with friction against the second module, so as to couple the modules for the purpose of damping their respective vibrational movements during operation.

The mechanical coupling between the first and the second rotor module allows increasing the tangential stiffness of the connection between these two rotors, while still allowing a certain axial and radial flexibility of the damping device so as to maximize contact between the different elements of the assembly. This makes it possible to limit the instabilities related to the vibration mode with zero dephasing, but also to participate in the damping of vibration modes with non-zero dephasing. In addition, such an assembly has the advantage of an easy integration within existing turbomachines, whether during manufacture or during maintenance. Indeed, the stepped structure of the damping device allows easier assembly, for example at the internal surface of the platform of a fan blade.

The assembly according to the invention can also comprise the following features, taken alone or in combination:

- the damping device also comprises an abutment surface supported against the connection between the first and the second module, so as to accomplish the axial retention of the damping device,
- the first rotor module comprises a disk centered on a turbomachine longitudinal axis, the first blade being mounted on the radial external periphery of the disk from which it extends, and also comprising an airfoil, a platform, a support and a root embedded in the recess of the disk, and the second module comprises a ferrule comprising a circumferential extension extending toward the platform of the first blade, the plurality of first radial external surfaces of the damping device being supported with friction on a plurality of respective internal surfaces of the platform of the first blade, the second radial external surface of the damping device being supported with friction against the circumferential extension of the ferrule of the second rotor module, the farthest downstream first radial external surface among the plurality of first radial external surfaces, and the second radial external surface, are dug by a bore, so as to form a U-shaped surface, each first radial external surface as well as the second radial external surface of the damping device are formed respectively from a sacrificial plate configured to guarantee the support with friction of said surfaces, the abutment surface is formed from a sacrificial plate configured to guarantee the axial support of the abutment surface, the plates comprise a coating of the dissipative type, the plates comprise a coating of the viscoelastic type, the plate forming the farthest downstream radial external surface has a variable thickness along the turbomachine longitudinal axis, the damping device comprises bores designed to lighten the damping device, the damping device comprises inserts, of the metallic type for example, designed add weight to the damping device, and the first module is a fan, and the second module a compressor, for example a low-pressure compressor.

The invention also relates to a turbomachine comprising an assembly as previously described.

The invention also relates to a stepped damping device comprising a plurality of first radial external surfaces configured to be supported with friction against a first module of an assembly as previously described, and also comprising a second radial external surface configured to be supported with friction against a second module of such an assembly, so as to couple the modules for the purpose of damping their respective vibrational movements during operation.

RAPID DESCRIPTION OF THE FIGURES

Figure 2:
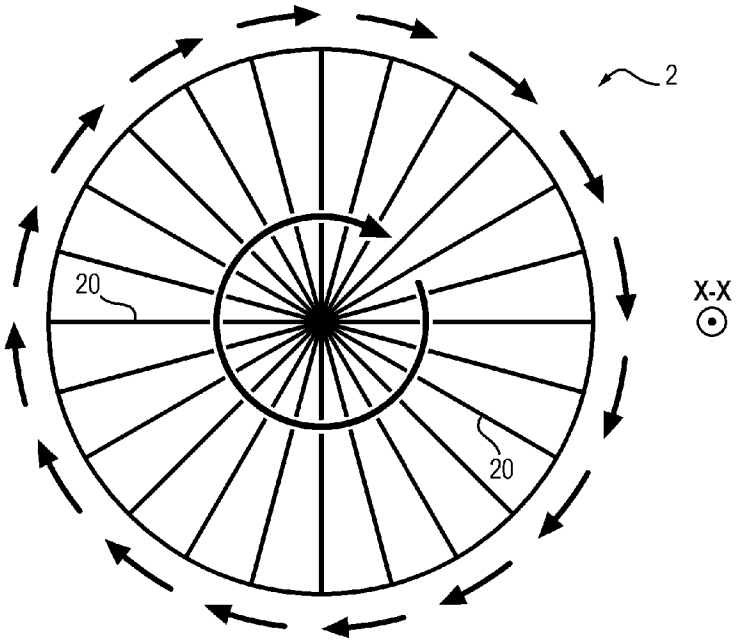
Figure 3A:
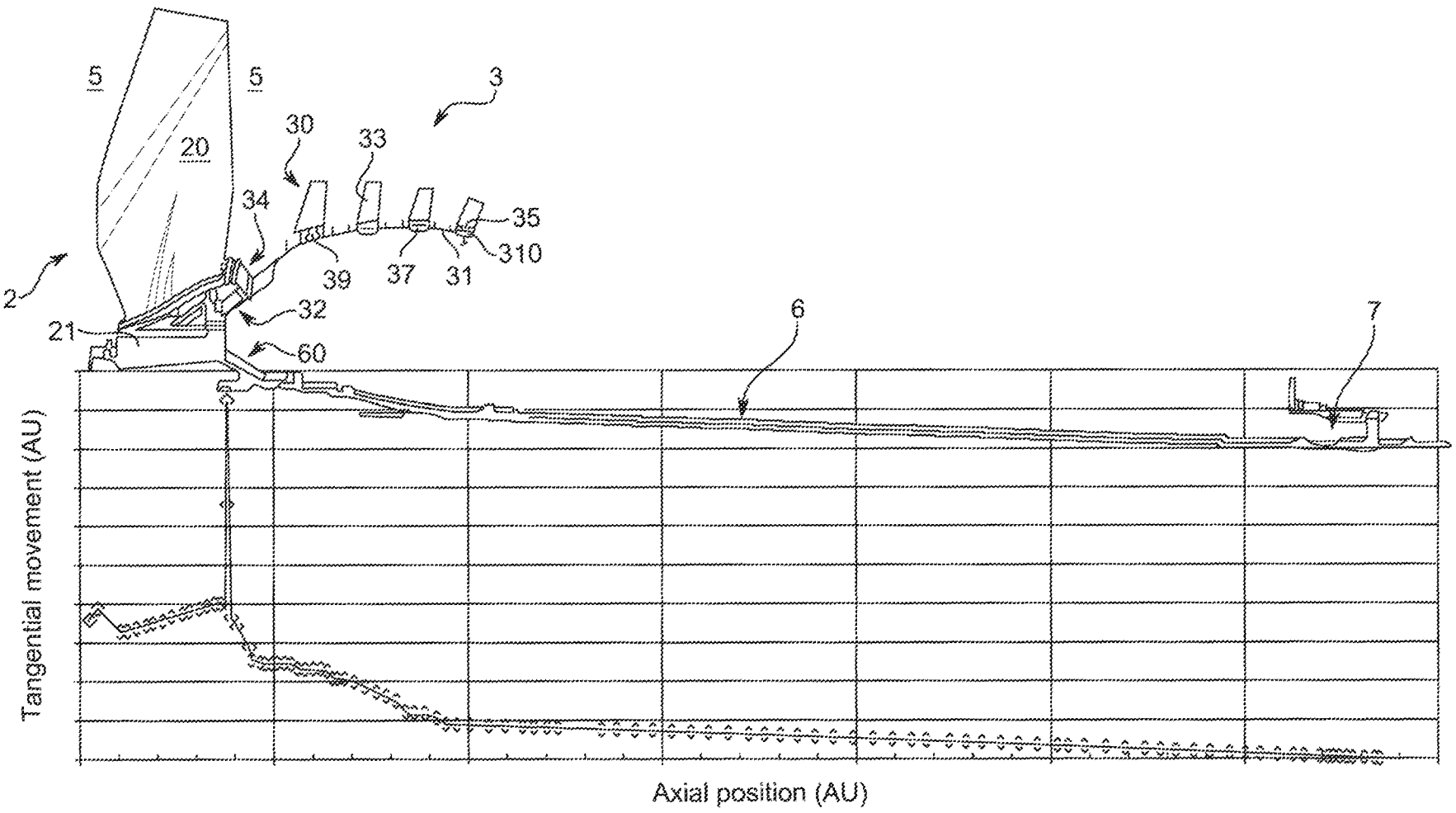
Figure 3B:
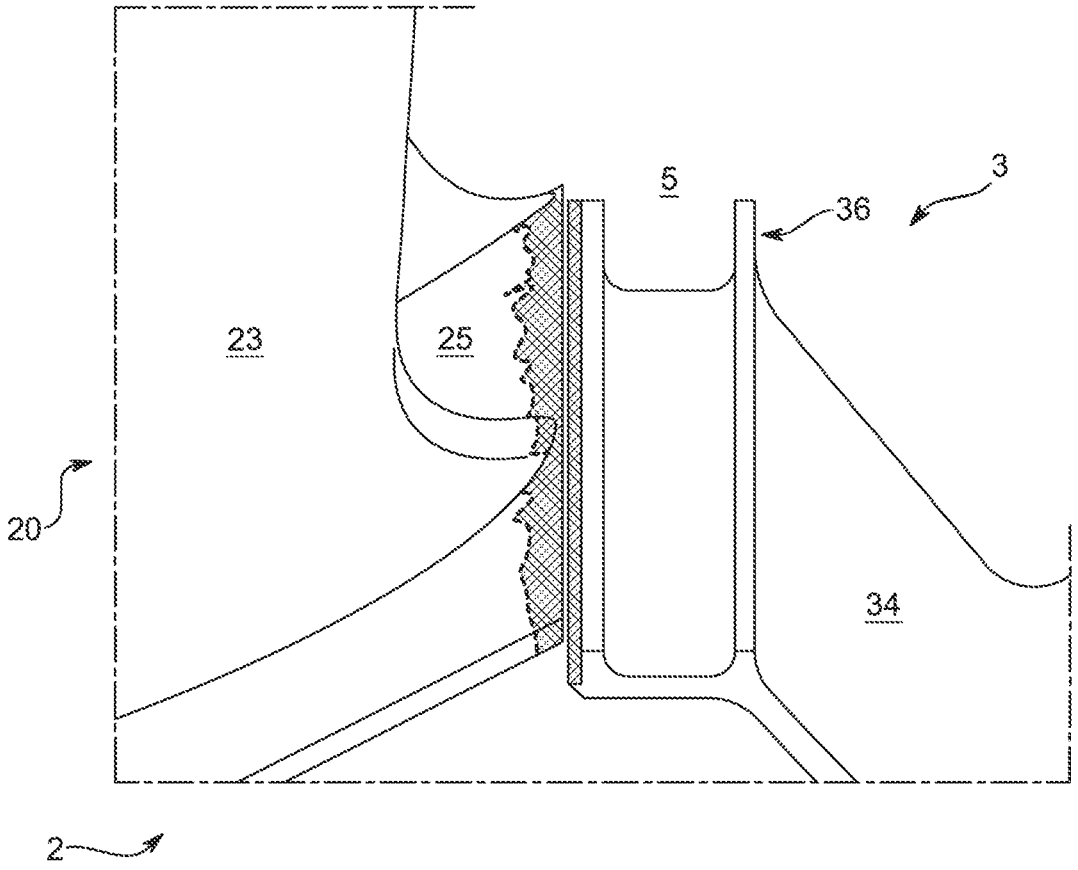
Figure 4A:
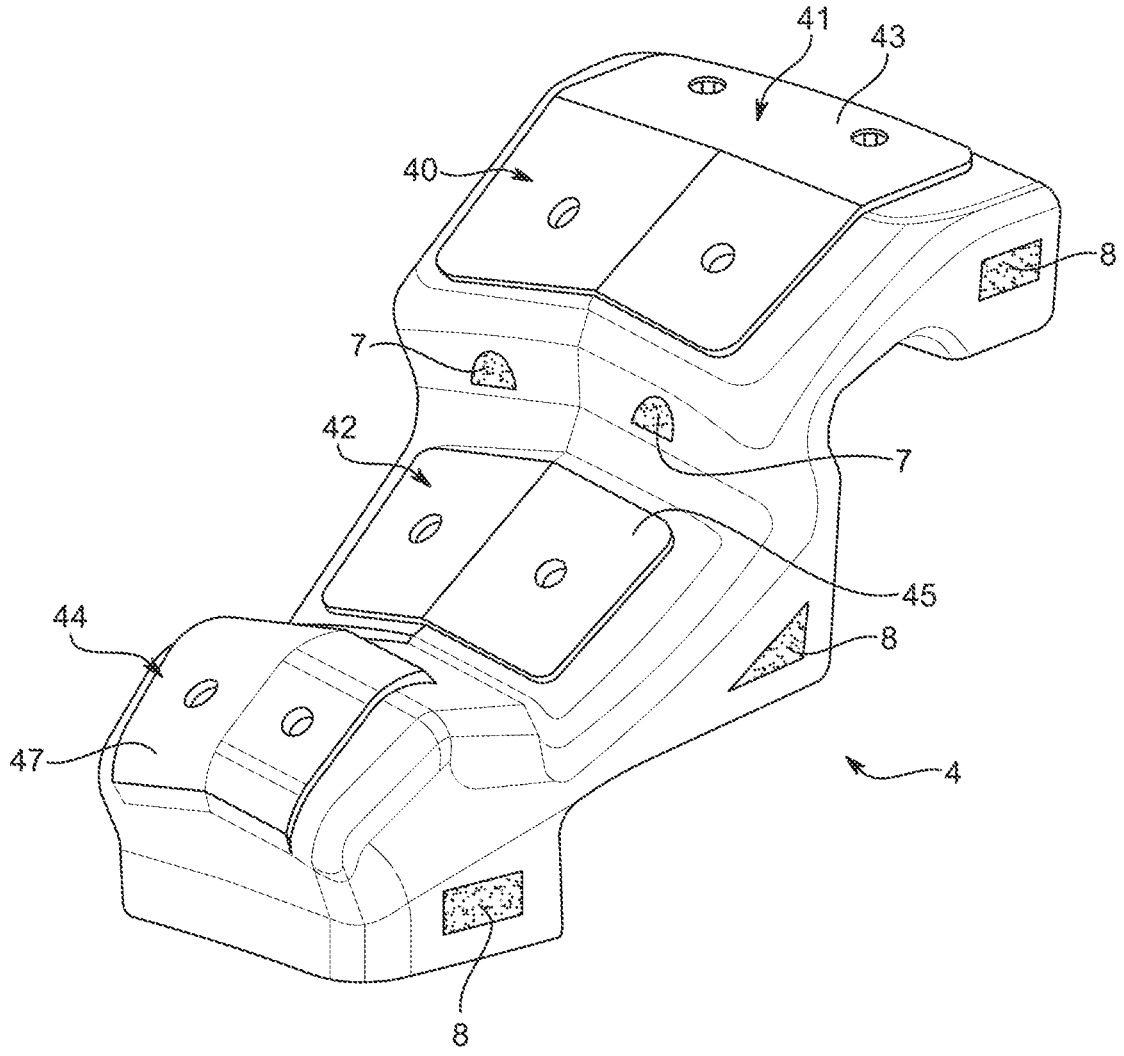
Figure 4B:
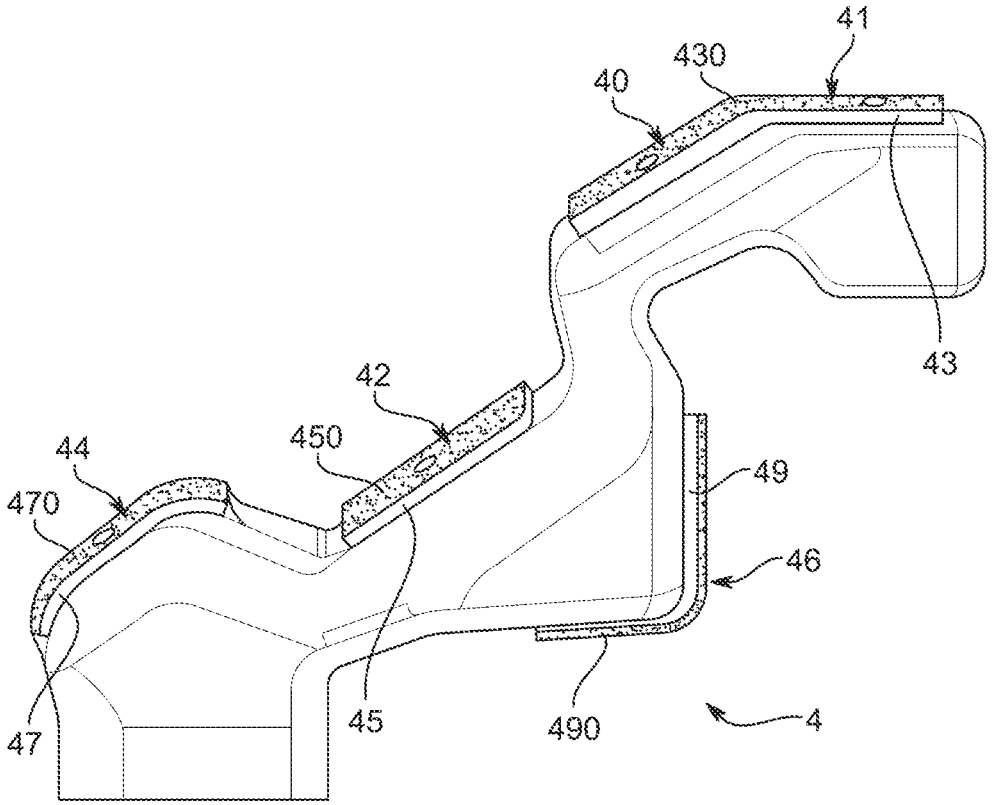
Figure 5A:
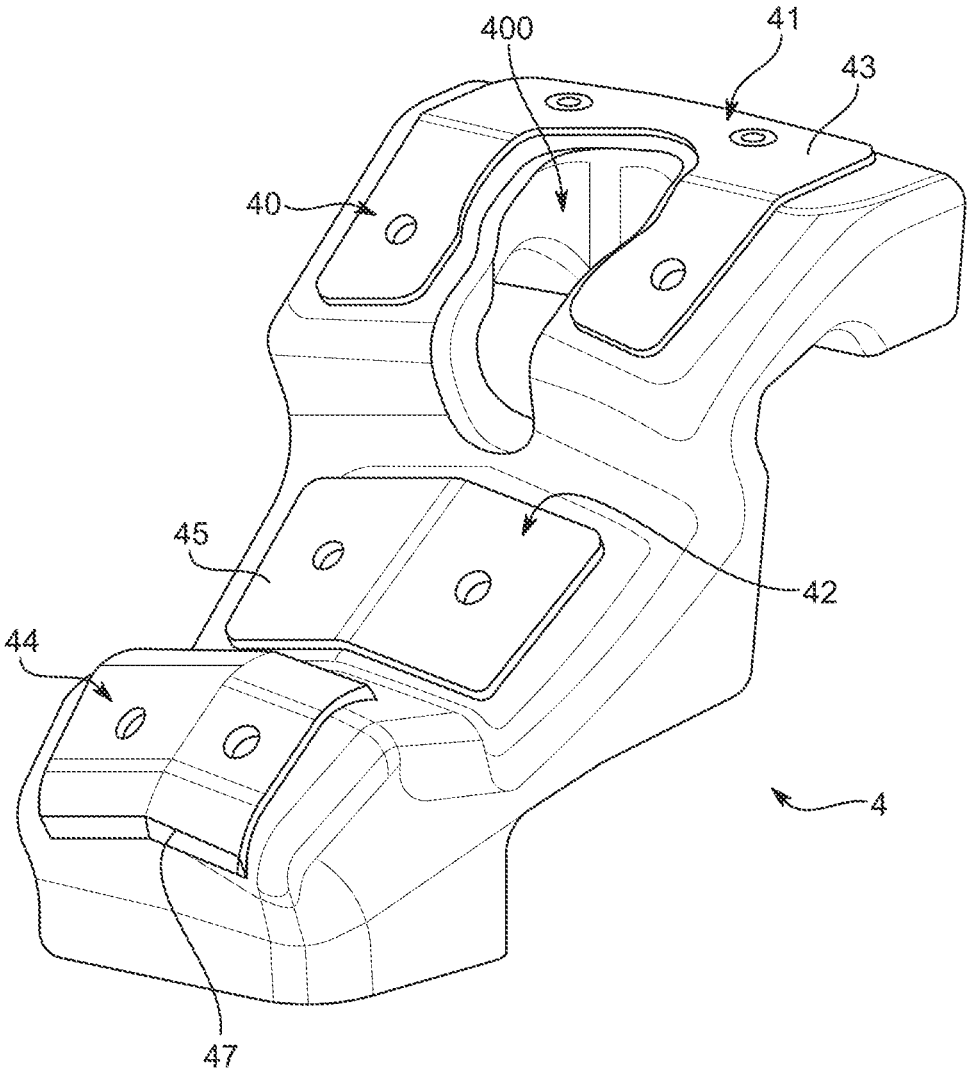
Figure 5B:
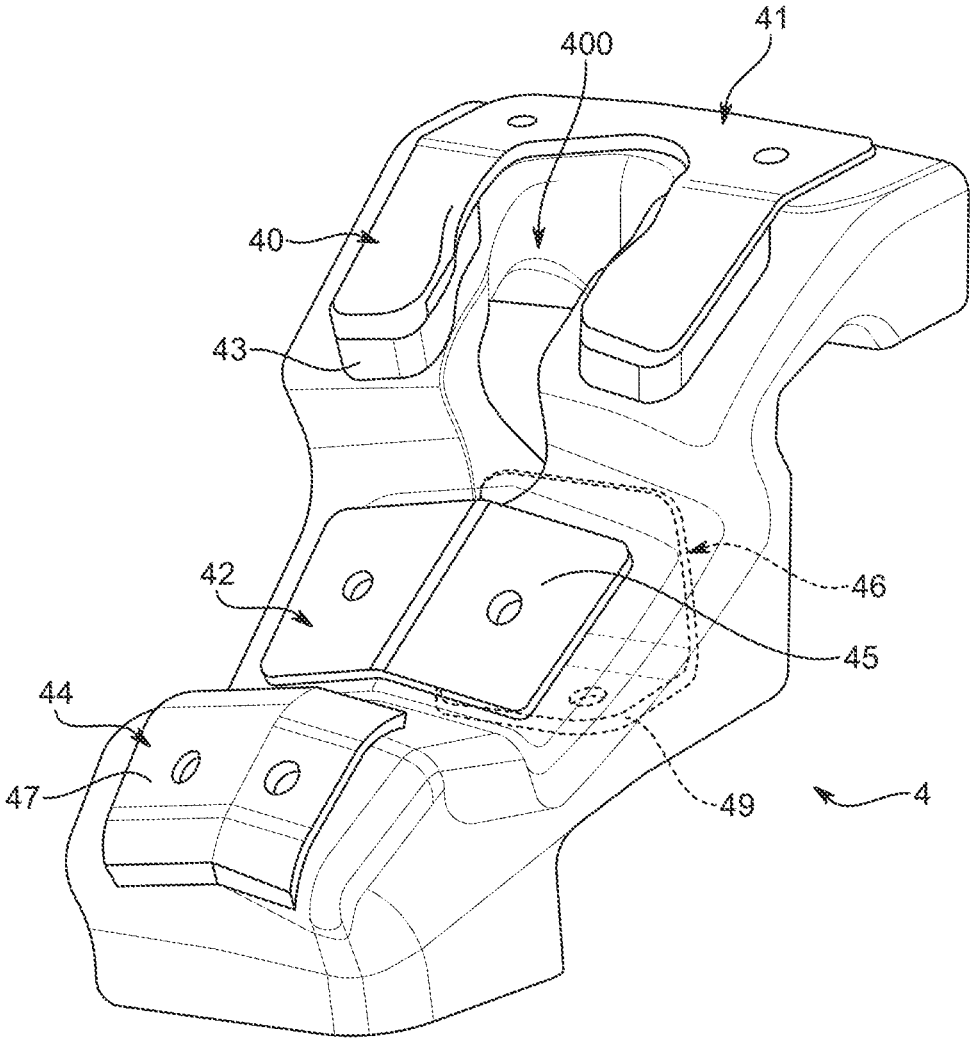

Other features, goals and advantages of the present invention will appear upon reading the detailed description that follows and with reference to the appended drawings given by way of non-limiting examples and in which:

FIG. 1 is a schematic section view of an exemplary embodiment of the assembly according to the invention, FIG. 2 is a front view of a rotor module subjected to tangential vibrations of which the mode has zero dephasing, FIG. 3*a* illustrates schematically tangential movements of the turbomachine rotor modules, as a function of the position of said modules along a turbomachine axis, FIG. 3*b* is an enlargement in schematic perspective of the interface between two turbomachine rotor modules illustrating its tangential movements relative to said rotor modules, FIG. 4*a* illustrates schematically a first exemplary embodiment of a damping device according to the invention, FIG. 4*b* illustrates schematically a second exemplary embodiment of a damping device according to the invention, FIG. 5*a* illustrates schematically a third exemplary embodiment of a damping device according to the invention, and FIG. 5*b* illustrates schematically a fourth exemplary embodiment of a damping device according to the invention.

DETAILED DESCRIPTION OF THE INVENTION

An exemplary embodiment of an assembly 1 according to the invention will now be described, with reference to the figures.

Hereafter, upstream and downstream are defined with respect to the normal flow direction of air through the turbomachine. Furthermore, a turbomachine longitudinal axis X-X is defined. In this manner, the axial direction corresponds to the direction of the turbomachine longitudinal axis X-X, a radial direction is a direction which is perpendicular to this turbomachine longitudinal axis X-X and which passes through said turbomachine longitudinal axis X-X, and a circumferential direction corresponds to the direction of a closed planar curve, of which all points are located at equal distance from the turbomachine longitudinal axis X-X. Finally, and unless the contrary is stated, the terms "internal (or interior)" and "external (or exterior)" respectively, are used with reference to a radial direction so that the internal (i.e. radially internal) portion or face of an element is closer to the turbomachine longitudinal axis X-X than the external (i.e. radially external) portion or face of the same element.

Referring to FIGS. 1 and 3*a*, such an assembly 1 comprises:

- a first rotor module 2 comprising a first blade 20,
- a second rotor module 3, connected to the first rotor module 2, and comprising a second blade 30 with a length smaller than the first blade 20, and
- a stepped damping device 4 comprising:
  - a plurality of first radial external surfaces 40, 42, 44 supported with friction against the first module 2, and
  - a second radial external surface 41 supported with friction against the second module 3,
  - so as to couple the modules for the purpose of damping their respective vibrational movements during operation.

By support "with friction" is meant that the contact between the radial external surfaces 41, 42 and, respectively, the first rotor module 2 and the second rotor module 3 occurs with friction. In other words, the support forces between the radial external surfaces 41, 42 and, respectively, the first rotor module 2 and the second rotor module 3 can be decomposed into pressure forces which are directed normal to the contact, and friction forces, directed tangentially to the contact. This support guarantees both the mechanical consistency of the assembly 1, by means of the pressure forces, but also the coupling between the modules 2, 3 for the purpose of damping their respective vibrational movements during operation, by means of the friction forces.

Referring to FIGS. 1 and 3*a*, the first rotor module is a fan 2, and the second rotor module is a low-pressure compressor 3, situated immediately downstream of the fan 2.

The fan 2 and the low-pressure compressor 3 comprise a disk 21, 31 centered on the turbomachine longitudinal axis X-X, the first 20 and the second 30 blade being respectively mounted on the external periphery of the disk 21, 31 and also comprising an airfoil 23, 33, a platform 25, 35, a support 27, 37 and a root 29, 39 embedded in a recess 210, 310 of the disk 21, 31. The distance separating the root 29, 39 from the end of the airfoil 23, 33 constitutes the respective lengths of the first 20 and of the second 30 blade. The length of the first blade 20 and second blade 30 is therefore considered here to be substantially radial with respect to the longitudinal axis X-X of rotation of the rotor modules 2, 3. In operation, the blade 23, 33 is swept by a flow 5 passing through the turbomachine, and the platform 25, 35 forms a portion of the internal surface of the flow path 5. Generally, as can be seen in FIGS. 2 and 3*a*, the fan 2 and the low-pressure compressor 3 comprise a plurality of blades 20, 30 distributed circumferentially around the longitudinal axis X-X. The low-pressure compressor 3 also comprises an annular ferrule 32 also centered on the longitudinal axis X-X. The ferrule 32 comprises a circumferential extension 34, also annular, extending toward the platform 25 of the first blade 20. This annular extension 34 carries radial knife edge seals 36 configured to prevent air flow rate losses from the flow path 5. Moreover, the ferrule 32 is attached to the disk 21 of the fan 2 by means of attachments 22 distributed circumferentially around the longitudinal axis X-X. Such attachments can for example be bolted connections 22. Alternatively, such attachments 22 can be achieved by an interference fit to which is associated an anti-rotation device and/or an axial locking system. Finally, with reference to FIG. 3*a*, the assembly formed from the fan 2 and the compressor 3 is rotated by a rotating shaft 6, called the low-pressure shaft, to which the fan 2 and the low-pressure compressor 3 are integrally connected, by means of a rotor trunnion 60, the low-pressure shaft 6 being also connected to a low-pressure turbine 7, downstream of the turbomachine, and extending along the turbomachine longitudinal axis X-X.

In operation, the fan 2 aspires air of which all or part is compressed by the low-pressure compressor 3. The compressed air then circulates in a high-pressure compressor (not shown) before being mixed with fuel, then ignited within the combustion chamber (not shown), to finally be successively expanded in the high-pressure turbine (not shown), and the low-pressure turbine 7. The opposite forces of compression, upstream and of expansion downstream cause aeroelastic flutter phenomena, which couple the aerodynamic forces on the blades 20, 30 and the flexural and torsional vibration movements in the blades 20, 30. As illustrated in FIG. 2, this flutter causes in particular intense torsional forces within the low-pressure shaft 6 which are fed through to the fan 2 and to the low-pressure compressor 3. The blades 20, 30 are then subjected to tangential pulses, particularly according to a vibration mode with zero dephasing. This is in fact a flexural mode with zero inter-blade 20, 30 dephasing, involving a non-zero moment on the low-pressure shaft 6, of which the natural frequency is approximately one and a half times greater than that of the first vibration harmonic, and of which the deformation has a nodal line at the half-height of the blade 20, 30. Such vibrations limit the mechanical performance of the fan 2 and of the low-pressure compressor 3, accelerate the wear of the turbomachine and reduce its lifetime.

As can be seen in FIG. 3*a*, the tangential movement by flutter of the fan 2 blade 20 is different from that of the ferrule 32 of the low-pressure compressor 3. Indeed, the length of the blade 20 of the fan 3 being greater than that of the low-pressure compressor 3 blade 30, the tangential flexural moment caused by the pulses of a fan 2 blade 20 is much greater than that caused by the pulses of a low-pressure compressor 3 blade 30. In addition, the stiffness of mounting within the fan 2 is different from that of mounting within the compressor 3. With reference to FIG. 3*b*, this deviation in tangential pulses is particularly visible at the interface between the platform 25 of a fan 2 blade 20, and the ferrule 32 knife edge seals 36.

In a first embodiment illustrated in FIG. 1, the damping device 4 is accommodated under the platform 25 of a fan 2 blade 20. All or a part of the fan 2 blades 20 can be equipped with such a damping device 4, depending on the damping desired, but also the acceptable characteristic maintenance periods.

The plurality of first radial external surfaces 40, 42, 44 is accommodated at the upper, or external portion, with respect to the turbomachine longitudinal axis X-X, of the damping device 4. This plurality of first radial external surfaces 40, 42, 44 is supported with friction against the fan 2 at a plurality of respective internal surfaces 250, 252, 254 of the platform 25 of the fan 2 blade 20. As can be seen in FIG. 1, this plurality of internal surfaces 250, 252, 254 delimits platform 25 bosses 251, 253 which protrude below the platform 25 in the direction of the longitudinal axis X-X. Advantageously, the external portion of the damping device 4 thus fits itself to the major portion of the internal surface of the platform 25, said surface being defined by the plurality of internal surfaces 250, 252, 254 and by the internal surface of the bosses 251, 253. Even more advantageously, as illustrated in FIG. 1, the damping device comprises three first support surfaces 250, 252, 254 and the platform comprises two bosses 251, 253. This is however not limiting, because such a damping device 4 can be implemented under any type of blade 20 platform 25.

The second face 41 is also external to the damping device 4, and supported with friction against the circumferential extension 34 of the ferrule 32. This ensures tangential coupling with high stiffness between the fan 2 and the low-pressure compressor 3, so as to reduce the tangential vibrations previously described. The coupling is in fact the greater as the zone in which the damping device 4 is disposed has the higher relative tangential movements for the zero-dephasing mode considered, as illustrated in FIGS. 3*a* and 3*b*. Typically, these relative displacements are on the order of a few millimeters. Furthermore, the damping device 4 also advantageously retains effectiveness on vibrational mode of the fan 2 blades 20 with non-zero dephasing.

As visible in the figures, the "stepped" structure of the damping device 4 results from the succession, from upstream to downstream, of the plurality of the first radial external surfaces 40, 42, 44 and from the second radial external surface 41, the first blade 20 platform 25 being inclined with respect to the longitudinal axis X-X. In addition, in the stepped structure of the damping device 4, the first 40 of the first radial external surfaces is closer to the longitudinal axis X-X than the second 42 of the first radial external surfaces, said second 42 of the first radial external surfaces being itself closer to the longitudinal axis X-X than the third 44 of the first radial external surfaces. In other words, in the stepped structure of the damping device 4, the first radial external surfaces 40, 42, 44 are each radially more and more distant from the longitudinal axis X-X. As can be seen in FIG. 3*a*, the inclination of the platform 25 advantageously allows guiding the flow of air 5 toward the inlet of the low-pressure compressor 3, of which the second blade 30 roots 39 are more distant from the longitudinal axis X-X than the first blade 20 roots 29.

In a second embodiment, with reference to FIGS. 1, 4*b* and 5*b*, the damping device 4 comprises an abutment surface 46 supported against the connection 22 between the fan 2 and the low-pressure compressor 3, so as to accomplish the axis retention of the damping device 4.

Advantageously as can be seen in the figures, this surface 46 forms an interior corner of the damping device 4, of which the two edges are mutually perpendicular so as to fit it to the shape of an attachment corner 22, such as an edge of a bolted connection 22.

In a third embodiment illustrated in FIGS. 4*a*, 4*b*, 5*a* and 5*b*, each first radial external surface 40, 42, 44, the second radial external surface 41, and the abutment surface 46 of the damping device 4 are formed respectively from a sacrificial plate 43, 45, 47, 49 configured to guarantee the support of said radial external surfaces 40, 41, 42, 44, 46 of the damping device 4 against the fan 2, the low-pressure compressor 3 and the connection 22 between the fan 2 and the low-pressure compressor 3. Indeed, the mechanical forces during operation are such that slight tangential, axial and radial movements of the damping device 4 should be expected. These movements are in particular due to the tangential pulses to be damped, but also the centrifugal loading of the assembly 1. It is necessary that these movements do not cause wear on the blades 20 or the ferrule 32, of which the coatings are relatively fragile. In this regard, the sacrificial plates 43, 45, 47, 49 comprise an anti-wear material, for example of the Teflon type, or any specific composite material known to the man skilled in the art. In addition, the sacrificial plates 43, 45, 47, 49 can be treated by dry lubrication, for the purpose of maintaining the value of the friction coefficient between the damping device 4 and the ferrule 32 and/or the blade 2 platform 25. This lubrication is for example of the MoS2 type.

For the purpose of improving the support with friction of the damping device 4, the sacrificial plates 43, 45, 47, 49 can also comprise an additional coating 430, 450, 470, 490, as can be seen in FIG. 4*b*. Generally, such a coating 430, 450, 470, 490 is configured to reduce the friction and/or the wear of the engine parts between the plate 42 and the rotor modules 2, 3.

This coating 430, 450, 470, 490 is for example of the viscoelastic type. Such a coating 430, 450, 470, 490 then advantageously comprises a material having properties similar to those of a material such as the range having the commercial designation "SMACTANE®," for example a material of the "SMACTANE® 70" type. Another means of increasing the tangential stiffness of the assembly 1 is to sufficiently preload the viscoelastic coating 430, 450, 470, 490, for example during the assembly of the assembly 1, so that the relative tangential movement between the blade 20 and the ferrule 32 is transformed into viscoelastic shear of the coating 430, 450, 470, 490 alone.

Alternatively, this coating 430, 450, 470, 490 is of the dissipative and/or viscoelastic and/or damping type. The dissipative coating 430, 450, 470, 490 then comprises a material chosen from those having mechanical properties similar to those of Vespel, of Teflon or of any other material with lubricating properties. More generally, the material has a coefficient of friction comprised between 0.3 and 0.07. In this manner, the damping device 4 is not too flexible tangentially. Too high a flexibility would not allow the damping of the mode with zero dephasing, because the relative movements of the fan 2 and of the low-pressure compressor 3 would lead to friction and/or oscillations between a "stuck" state and a "slipping" state of the damping device 4.

These additional coatings 430, 450, 470, 490 are applied by gluing to the sacrificial plates 43, 45, 47, 49.

Advantageously, as can be seen in FIG. 5*b*, the plate 43 forming the farthest downstream radial external surface 40 has a variable thickness along the turbomachine longitudinal axis X-X. Preferably, the farthest upstream plate 43 portion is thicker than the plate 43 portion farthest downstream. This allows optimizing the distribution of forces in the coupling between the fan 2 and the low-pressure compressor 3.

In a fourth embodiment illustrated in FIG. 4*a*, damping by tangential coupling can be adjusted by controlling the mass of the damping device 4, which influences the shear inertia. This control involves modifications of the mass of the damping device 4. This mass can be modified in all or a part of the damping device 4, typically by making bores 7 to lighten it, and/or adding one or more inserts 8, metallic for example, to weigh it down.

Advantageously, the combination of the third and fourth embodiment allows adjusting the contact forces between the damping device 4 and the fan 2 and the low-pressure compressor 3. Indeed, contact forces that are too high between the fan 2 blade 20 and the damping device 4 would limit the dissipation of vibrations during operation.

In a fifth embodiment illustrated in FIGS. 5*a* and 5*b*, the farthest downstream first radial external surface 40 among the plurality of first radial external surfaces 40, 42, 44, and the second radial external surface 41, are dug by a bore 400 so as to form a U-shaped radial external surface 40. The bore 400 can pass through all or a part of the downstream portion of the damping device 4.

This bore 400 allows an increase in the flexibility of the downstream portion of the damping device 4. In addition, the U configuration allows adapting the support with friction of the radial external surface 40 to the deviations between two circumferentially successive blades 20. Thus, the static redundancy of the damping device 4 is advantageously reduced.

Different embodiments of the assembly 1 according to the invention have been described in the case where the first rotor module 2 is a fan, and the second rotor module 3 is a low-pressure compressor.

This, however, is not limiting, because the first rotor module 2 can also be a first, high- or low-pressure, compressor stage, and the second rotor module 3 a second stage of said compressor, successive to the first compressor stage, upstream or downstream of the latter. Alternatively, the first rotor module 2 is a first, high- or low-pressure, turbine stage and the second rotor module 3 a second stage of said turbine, successive to the first turbine stage, upstream or downstream of the latter.

The invention claimed is:

1. A turbomachine assembly comprising:

a first rotor module comprising a first blade, a second rotor module, connected to the first rotor module at a connection, and comprising a second blade of smaller length than the first blade, and a damping device comprising a plurality of first radial external surfaces supported with friction against the first rotor module, wherein the damping device is stepped and comprises a second radial external surface supported with friction against the second rotor module, so as to couple the first rotor module with the second rotor module in order to dampen a vibrational movement of the first rotor module with respect to the second rotor module during operation, and wherein a bore is formed both into a farthest downstream first radial external surface among the plurality of first radial external surfaces and into the second radial external surface so as to form a U-shaped surface.

2. The turbomachine assembly of claim 1, wherein the damping device further comprises an abutment surface supported against the connection between the first rotor module and the second rotor module, so as to accomplish an axial retention of the damping device.

3. The turbomachine assembly of claim 2, wherein the abutment surface is formed from a sacrificial plate configured to guarantee an axial support of the abutment surface.

4. The turbomachine assembly of claim 1, wherein:

the first rotor module comprises a disk being centered on a turbomachine longitudinal axis and presenting an external periphery, the first blade being mounted on the external periphery of the disk from which the first blade extends, the first blade further comprising an airfoil, a platform, a support and a root embedded in a recess of the disk, and the second rotor module comprises a ferrule comprising a circumferential extension extending toward the platform of the first blade, the plurality of first radial external surfaces of the damping device being supported with friction on a plurality of respective internal surfaces of the platform of the first blade, the second radial external surface of the damping device being supported with friction against the circumferential extension of the ferrule of the second rotor module.

5. The turbomachine assembly of claim 1, wherein each first radial external surface as well as the second radial external surface of the damping device are formed respectively from a sacrificial plate configured to guarantee a support with friction of the plurality of first radial external surfaces and the second radial external surface.

6. The turbomachine assembly of claim 5, wherein the sacrificial plates comprise a dissipative coating.

7. The turbomachine assembly of claim 5, wherein the sacrificial plates comprise a viscoelastic coating.

8. The turbomachine assembly of claim 5, wherein the first rotor module comprises a disk being centered on a turbomachine longitudinal axis, and wherein the sacrificial plate forming the farthest downstream radial external surface has a variable thickness along the turbomachine longitudinal axis.

9. The turbomachine assembly of claim 1, wherein the damping device comprises lightening bores designed to lighten the damping device.

10. The turbomachine assembly of claim 1, wherein the damping device comprises inserts designed to add weight to the damping device.

11. The turbomachine assembly of claim 1, wherein the first rotor module is a fan, and the second rotor module is a low-pressure compressor.

* * * * *